US005529084A

United States Patent [19]

Mutsakis et al.

[11] Patent Number: 5,529,084

[45] Date of Patent: Jun. 25, 1996

[54] LAMINAR FLOW ELBOW SYSTEM AND METHOD

[75] Inventors: Michael Mutsakis, Brooklyn, N.Y.; Chang-Li Hsieh, Carlisle, Mass.; Dag O. Calafell, II, Wichita, Kans.

[73] Assignee: Koch Engineering Company, Inc., Wichita, Kans.

[21] Appl. No.: 217,362

[22] Filed: Mar. 24, 1994

[51] Int. Cl.[6] ..... F17D 1/20; F15D 1/04

[52] U.S. Cl. ..... 137/13; 138/37; 138/39

[58] Field of Search ..... 137/8, 13, 808, 137/809, 810; 138/37, 39

[56] References Cited

U.S. PATENT DOCUMENTS

| | | | |
|---|---|---|---|
| 1,937,875 | 12/1933 | Denman et al. | 138/37 X |
| 1,974,109 | 9/1934 | Higley | 137/112 |
| 1,974,110 | 9/1934 | Higley | 137/112 |
| 3,219,046 | 11/1965 | Wough | 137/8 |
| 3,724,499 | 4/1973 | Huniu | 137/615 |
| 3,827,461 | 8/1974 | Gilman | 138/37 X |
| 3,934,614 | 1/1976 | Elek et al. | 138/44 |
| 3,938,967 | 2/1976 | Reissmüller | 138/37 X |
| 3,945,402 | 3/1976 | Murphy | 137/8 X |
| 3,955,835 | 5/1976 | Farrington | 138/37 X |
| 4,080,997 | 3/1978 | Biornstad | 138/37 |
| 4,130,173 | 12/1978 | Cooksey | 138/37 X |
| 4,232,710 | 11/1980 | Galla et al. | 137/615 X |
| 4,309,146 | 1/1982 | Hein et al. | 415/4.2 X |
| 4,466,741 | 8/1984 | Kojima | 138/37 X |
| 4,522,058 | 6/1985 | Ewing | 138/108 X |
| 4,581,048 | 4/1986 | Svobada | 55/185 |
| 4,596,586 | 6/1986 | Danes et al. | 55/52 |
| 4,821,768 | 4/1989 | Lett | 138/37 X |
| 4,824,614 | 4/1989 | Jones | 138/37 X |
| 4,898,512 | 2/1990 | Geffs | 415/117 X |
| 5,180,257 | 1/1993 | Narishima et al. | 138/37 X |
| 5,197,509 | 3/1993 | Cheng | 137/13 |
| 5,323,661 | 6/1994 | Cheng | 138/39 X |

FOREIGN PATENT DOCUMENTS

| | | | |
|---|---|---|---|
| 3585389 | 12/1989 | Australia . | |
| 156269 | 10/1985 | European Pat. Off. . | |
| 2218494 | 9/1974 | France . | |
| 2140419 | 3/1977 | Germany . | |
| 29113 | 2/1982 | Japan | 137/8 |
| 143214 | 7/1985 | Japan | 138/37 |
| 160614 | 7/1986 | Japan | 138/37 |
| 887821 | 12/1981 | U.S.S.R. . | |
| 1312298 | 5/1987 | U.S.S.R. | 138/39 |
| 774033 | 5/1957 | United Kingdom | 138/37 |
| 2041477A | 9/1980 | United Kingdom . | |
| 2146139 | 4/1985 | United Kingdom | 138/37 |

*Primary Examiner*—John Rivell
*Attorney, Agent, or Firm*—Richard P. Crowley

[57] ABSTRACT

An improved laminar flow elbow system and method wherein the elbow system comprises a straight pre-pipe section to define the flow path of a fluid; the pipe section included directly prior to the inlet of a curved pipe section and having and comprising a plurality of vanes to impart a rotation to the fluid before passing through a curved pipe section to provide a generally flat velocity profile at the exit of the curved pipe section and to minimize turbulence of the fluid as it passes through the curved pipe section, and a substantially straight post-pipe section to define a flow path exit pipe section included directly at the exit of the curved pipe section, and containing a plurality of vanes to impart a backward rotation movement to the fluid flow from the exit of the curved pipe section, to substantially terminate rotation of the fluid upon exiting from the straight pipe section without substantial deterioration of the flatness of the fluid velocity profile and without generating substantial amounts of turbulence.

38 Claims, 7 Drawing Sheets

SEC. A-A
3A $$\theta \text{ MAX} = \frac{1}{4} \frac{D}{R_{10}} \phi$$

$$\theta = \frac{1}{4} \frac{D_1}{R_{10}} \phi$$

LAMINAR FLOW ELBOW SYSTEM AND METHOD

BACKGROUND OF THE INVENTION

Laminar flow elbow systems and methods are known for which a pipe section comprising a substantially straight pipe section defines a flow path for fluid, and said straight pipe section is adapted for inclusion prior to a curved pipe section, such as a 90° elbow, and which straight pipe section includes a plurality of vanes therein as a means for imparting rotation of said fluid before passing through the curved pipe section, and typically with said fluid rotation imparting means being fixed within said straight pipe section. The plurality of vanes within the straight pipe section which composes the rotation imparting means typically is designed to impart sufficient rotation to the fluid to minimize turbulence and flow maldistribution as it passes through the curved pipe section, while insuring that the fluid rotation substantially terminates upon exiting from the curved pipe section. Typically, the pre-elbow pipe section is straight and circular, and the elbow pipe section has an inclusion angle and a turning radius with the turning vane curvature employed in the rotation-imparting means having a maximum angle Theta proximal to the pre-elbow pipe section wall. The Theta angle is approximately equal to ¼ of the pre-elbow pipe sections in internal diameter, multiplied by the inclusion angle and divided by the turning radius, thereby turbulence and flow maldistribution are minimized as fluid flows through the pipe elbow. Such laminar flow elbow systems and methods are described, for example, in U.S. Pat. No. 5,197,509, issued Mar. 30, 1993, hereby incorporated by reference in its entirety.

It is desired to provide for a new and improved laminar flow elbow system and method or means for imparting forward and backward rotation to a fluid passing through a defined flow path and through straight and curved pipe sections through a system to overcome certain disadvantages found in such prior art systems. It is also desirable to provide for a fluid rotation-imparting means such as a pipe section having a plurality of vanes which provide certain operating, functional, and manufacturing cost and efficiency advantages not present in the prior art.

SUMMARY OF THE INVENTION

The invention relates to an improved laminar flow elbow system and method and in particular concerns a laminar flow elbow section apparatus having fluid flow rotation means therein, and a new and improved fluid rotation apparatus adapted for use prior to or after a curved pipe section.

The invention comprises a pipe section apparatus of a substantially straight postpipe section which defines a flow path of a fluid, said pipe section being adapted for inclusion directly after a curved pipe section having an inlet and an exit, and wherein a fluid exits the curved pipe section having a fluid rotation, and which straight pipe section includes a fluid rotation terminating and parting means fixed within said straight pipe section to receive rotating fluid exiting from a curved pipe section, and to terminate substantially the fluid rotation of the exiting fluid by imparting a rotation in the opposite direction to said rotating fluid without substantial deterioration of the flatness of the received fluid velocity profile, and optionally without generating a substantial amount of turbulence or any substantial increase in pressure drop of the fluid. The fluid rotation terminating means can accept a rotating fluid where: (1) the fluid has a substantially flat velocity profile, or (2) the fluid has a non-flat (skewed) velocity profile, and where said means will terminate fluid rotation without substantial deterioration of the flatness of the received fluid velocity profile.

The invention includes an improved laminar flow elbow system, wherein the pipe section apparatus containing the fluid rotation termination-imparting means is placed directly adjacent the exit of the curved pipe section, such as the 90° pipe elbow, for example, a curved pipe section having an angle of about 30° to a return bend of 180°, and which improved laminar flow elbow system would provide a means for imparting forward rotation to a fluid at the inlet of the curved pipe section to provide a substantially flat velocity profile for the fluid at the exit of the curved pipe section and to minimize turbulence, and which typically would comprise, but not be limited to, the plurality of vanes having a zero angle of attack adjacent and aligned with the fluid flow path and the vanes having a leading and trailing edge to impart a defined amount of a fluid rotation through the fluid entering the curved pipe section. Thus, the improved laminar flow elbow system of the invention may employ as the means for imparting forward fluid rotation and to minimize turbulence the laminar flow pipe section as set forth and described in U.S. Pat. No. 5,197,509, or any other means to impart forward fluid rotation to minimize turbulence and to provide a substantially flat fluid velocity profile at the exit of the curved pipe section.

The invention also includes a pipe section apparatus which comprises a substantially straight pipe section to define a flow path for the fluid and adapted to be inserted either prior to and at the entrance of the curved pipe section, or after and at the exit of a curved pipe section, or both, and wherein the pipe section includes a fluid rotation-imparting means fixed within the straight pipe section to impart desired rotation to the fluid to minimize turbulence and to provide a substantially flat velocity profile for the fluid, which typically would comprise a plurality of at least one vane, but typically a plurality of vanes with each having a curvature and wherein the rotation imparting means is characterized by an open, coreless, center section, therefore to define a coreless rotation imparting means to use in a laminar flow elbow system and method. Typically, the coreless rotation-imparting means would include a plurality of generally uniformly spaced-apart vanes, each having a curvature and each vane having a leading edge and a trailing edge, and the vanes extending generally inwardly a short distance from the internal diameter of the straight pipe section, up to 10%–70% of the radius of said straight pipe section, and toward the center axis. The coreless rotation-imparting means may have a leading edge on the vanes, which presents a substantially zero angle of attack to the fluid at the inlet of the straight pipe section where it is placed adjacent the inlet of the curved pipe section, or to present the curved blade section of the coreless rotation imparting means when placed directly at the exit of the curved pipe section. Thus, the open, coreless, center section of the rotation-imparting means comprises a significant improvement over the rotation-imparting means as described in U.S. Pat. No. 5,197,509, which comprises a plurality of vanes having a curvature wherein the vanes extend and do not have a coreless center.

The invention includes a method of providing a fluid in the fluid flow path having substantially no fluid rotation at the exit of the rotation termination means after the curved pipe section, a substantially flat fluid velocity flow profile, and, optionally, with a minimum of turbulence and with a low pressure drop. The method comprises imparting the fluid rotation, such as a forward fluid rotation, to a fluid in a flow path prior to passing the fluid into a curved pipe section, and then receiving the rotating fluid as it exits from a curved pipe section, passing the fluid through a rotation termination means in a desire to angle the rotation into a plurality of vanes, generally with a zero angle of departure to terminate substantially the fluid rotation of the fluid as it exits the curved section while maintaining a substantially flat fluid velocity flow profile. The method of providing the fluid having substantially no fluid rotation and yet maintaining substantially a flat velocity profile is accomplished in one embodiment by employing a rotation-imparting means as described in U.S. Pat. No. 5,197,509; however, placing the rotation-imparting means at the exit of the curved pipe section and reversing the rotation-imparting means so as to impart a backward rather than a forward rotation to the fluid as the fluid exits the curved pipe section. Improved laminar flow elbow systems, pipe sections, and coreless and tapered rotation-imparting and termination means and methods of the invention provide significant and improved advantages over the prior art as described in U.S. Pat. No. 5,197,509, and overcomes several disadvantages of the prior art.

When a pre-rotator, which is that shown and illustrated in FIG. 6B of U.S. Pat. No. 5,197,509, is installed in front of an elbow, the velocity profile exiting from the elbow is more uniform than the velocity profile exiting from a plain and similar elbow without a pre-rotator. However, it has been discovered that in the turbulent flow regime, the fluid exiting from a pre-rotator and elbow combination, that is, the laminar flow elbow system and method of U.S. Pat. No. 5,197,509, will continue to rotate at an angle of rotation, (yaw) essentially the same or even slightly less than the angle of rotation created by the upstream pre-rotator. Further, it has been discovered that the rotation of the fluid at the exit of the elbow exists regardless of the pre-rotator angle Theta being higher, at, or lower than the Theta maximum angle as set forth in U.S. Pat. No. 5,197,509. This discovery is contrary, to the teachings of U.S. Pat. No. 5,197,509 which states that at a pre-rotator angle of less than Theta, rotation of the fluid at the elbow exit substantially terminates.

It is recognized that for rotating equipment such as pumps, compressors, blowers and other equipment operated by rotating impellers for the movement of the fluid, and located close downstream of an elbow, flow separation regions in the fluid and the skewed (not flat) fluid velocity profile created by the curved pipe section or elbow can be detrimental to the performance of such rotating-type equipment. For example, it is well known that the design of impellers, that is the shape and angle of the blades employed for rotating equipment, generally assumes that the entering fluid has a fiat velocity profile and little or no rotating of the fluid. Therefore, the existence of fluid pre-rotation implies flow separation along one side of the impeller vanes, and the existence of skewed fluid velocity profiles striking the impeller implies and provides poor filling of the impeller and unequal mechanical forces, which could result in a detriment to the rotating equipment performance, efficiency, and mechanical stability. It is however recognized that with fixed speed compressors and blowers, fluid prerotators (variable pitch and direction) are often used to change the performance characteristics (flow-head) of the machine.

It has been found that when installing a prior art pre-rotator upstream of a 90° elbow, the fluid is rotated as it negotiates the elbow turn and eliminates the flow separation regions and the skewed velocity profile created by employing a 90° elbow, and creates a relatively fiat fluid velocity profile at the elbow exit. It has been found, however, that the fluid continues its rotation, which can be detrimental to the operating efficiency and performance of fluid processing rotation equipment located close downstream of the laminar flow elbow system, whose impellers are designed for no fluid pre-rotation. It is well recognized that fluid rotation can cause adverse effects on fluid processing equipment, such as a pump whose impeller is designed for no fluid pre-rotation, by decreased head when fluid rotation is in the direction of the pump impeller rotation, and increased head when the fluid rotation is opposite (anti-rotation) to the pump impeller rotation (with attendant effects on capacity). The increased head (with attendant effects on capacity) due to anti-rotation may be viewed as positive to the performance of the equipment however, it is also associated with an increase in power required and may also cause pump overheating or other disadvantages.

Further, in other types of process equipment such as flow meters and other instruments, installing a flow meter (depending on type) directly downstream at the exit of a plain elbow can affect the accuracy of the meter, because of a skewed flow and velocity profile, fluid cavitation (flashing) caused by elbow induced flow separation regions, fluid rotation, or all. For this reason, flow meter manufacturers normally specify the minimum number of diameters downstream of an elbow, or multiple elbows, that are required with equipment in order to insure measurement accuracy. Flow meters, other types of instruments and impellers of fluid processing rotating equipment, are usually designed for the flow introduced into the device to exhibit a flat velocity profile with no rotation; therefore, while installing a prior art pre-rotator upstream of an elbow creates a relatively flat velocity profile at the elbow exit, it has been discovered the fluid stream will continue to rotate, which may be detrimental to the performance of the flow meter or other fluid operating type of equipment.

Therefore, it has been discovered that by employing a rotation terminating means, such as a backward rotation vane composed of a plurality of curved vanes, that is, a prerotator of the prior art, in place in an adverse position, effectively terminates fluid rotation created by any upstream pre-rotator or other means which would rotate the fluid, at minimum pressure drop and without deteriorating the quality, that is the flatness of the velocity profile, and with minimum turbulence. It has also been discovered that the employment of a forward or backward rotation-imparting means employing a coreless center section creates a flatter velocity profile, exhibits a lower pressure drop, has lower manufacturing costs, and is less susceptible to plugging when processing fibrous and particulate materials in the fluid stream. Thus, the coreless forward rotation vane may be employed as a pre-rotator or a rotation termination means or a combination of both, however, when the coreless forward rotation vane is employed in a pre-rotator, rotation of the fluid stream continues at the exit of the elbow unless a backward rotation vane as a terminating means is employed, particularly at the elbow exit.

The invention is thus directed to a means and method of effectively terminating fluid rotation exiting from a curved pipe section, such as a 90° or other curved elbow, wherein the fluid exiting from the elbow has a substantially flat velocity profile, but continues rotation. The fluid rotation generated, for example, by a prior art pre-rotator located upstream of an element of an elbow, can be terminated by being positioned by a rotation termination means or a backward rotation vane immediately downstream of the exit of the elbow, typically within a one pipe diameter of the exit of the elbow. It has been found that the rotation termination means should have a designed inlet angle of attack Theta of the blades within ±10° of the rotating fluid entrance angle Theta, and that the rotation termination means and the blades should be oriented in the direction of fluid rotation, therefore the exit angle of the backward rotation vane as employed at the exit of the curved pipe section should be about substantially zero degrees, such as the flow exiting the backward rotation vane, is directed downstream and imparts at the exit of the backward rotation means no substantial rotation of the fluid. Therefore, by employing a prior art pre-rotator or a coreless pre-rotator and an elbow, and a backward rotation vane combination, the fluid exiting the backward rotation means will have a relatively flat velocity profile, and no residual fluid rotation.

Typically, the rotation termination or backward rotation vane means employed may have a plurality of curved vanes having a leading and trailing edge, and numbering and spacing of the vanes may vary. However and generally, the vanes contain between three to six vanes, and are generally uniformly spaced around a center axis, and the blade profile may be similar to that of the prior art pre-rotator, except that the backward rotation vane means is the reverse of the prior art pre-rotator, that is where the prior art pre-rotator vanes have a zero angle of attack on the leading edge in the direction of fluid flow, and an angle Theta on the trailing edge, the backward rotation vanes have a Theta angle of attack on the leading edge in the direction of flow, and a zero angle on the trailing edge. It has also been found that the backward rotation vane can be designed with the profile of a coreless pre-rotator. In one embodiment, the forward and backward rotation vanes in the system may be duplicated with about the same vane angle Theta for reasons of economy.

It has been discovered that the backward rotation vane or rotation terminating means employed directly at the exit of a curved pipe section should be located generally immediate to the exit of the curved pipe section, and typically within one diameter, since location of the backward rotation vanes at a substantial distance, say two or more diameters downstream of the elbow, is not effective; therefore, in order to terminate fluid rotation at the lowest possible pressure drop, it is essential that the rotation (yaw) and angle (pitch) of the rotating stream match the backward rotation vane leading edge blade profile. The rotation (yaw) and the angle (pitch) of a rotating fluid as it exits a curved pipe section decreases (decays) as it travels down a downstream pipe, so that if the yaw and pitch of the leading edge of the backward rotation vane does not match that of the rotating fluid, the result is a high pressure drop, inability to terminate rotation, and a possibility of over-correcting resulting in a new rotation of the fluid. Therefore, the rotating fluid and the backward rotation vane angle of attack blade configuration must match so that the fluid rotation terminates with a low pressure drop.

It is recognized in the invention that the rotation termination means as described, whether either of the coreless or the core type, can be employed on any curved pipe exit, wherein the fluid has a substantially fiat velocity profile on the exiting, but where the fluid rotates, and the rotation termination means is designed to impart an opposite rotation to the fluid rotation at the exit of the curved pipe section. It is further recognized that the rotation terminating means can be employed in any straight pipe section where the fluid has a substantially fiat velocity profile, but where the fluid rotates, and the rotation termination means is designed to impart an opposite rotation to the fluid rotation. The forward rotation-imparting means of the prior art or any forward rotation-imparting means may be located prior to a curved pipe section, and which may be substantially upstream of the curved pipe section, and therefore the rotation termination means may be employed in any sequence, such as a forward rotation means, a curved pipe section, a straight pipe section, one or more curved pipe sections and straight pipe sections, followed by a curved pipe section having a rotation termination means. The forward rotation-imparting means being employed prior to the curved pipe section or in a straight pipe section in front of the rotation termination means, may include a pre-pipe containing a plurality of curved vanes therein, the blades meeting and welded in the center, or any other design or shape which would include cyclones, propeller type pumps, out-of-plane series of elbows, various static mixers or combinations of any other type of device which may comprise plates, vanes or holes drilled in a plug to provide a swirl, that is a rotation of the fluid downstream of the device.

The invention will be described for the purposes of illustration only in connection with certain illustrative embodiments; however, it is recognized that those persons skilled in the art may make various changes, modifications, improvements and additions all falling within the spirit and scope of the invention.

DESCRIPTION OF THE EMBODIMENTS

Figure 1:
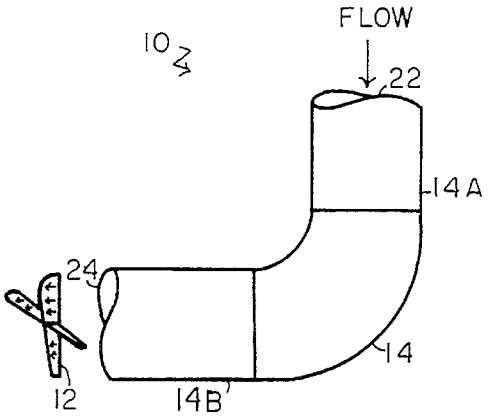
PRIOR ART FIG. 1
FIG. 1 is a prior art illustration of a fluid flow path through a plain elbow system with a distorted fluid velocity profile created by the elbow.
Figure 2:
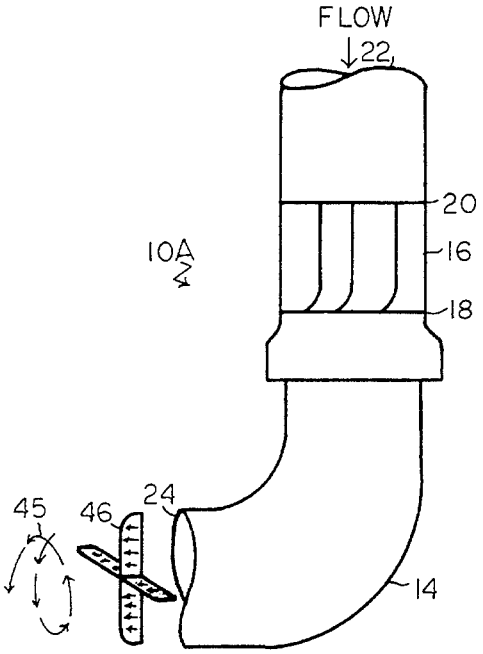
PRIOR ART FIG. 2
FIG. 2 is a prior art illustration of a fluid flow path through a laminar flow elbow system containing a pre-rotator followed by an elbow where the pre-rotator creates a relatively flat fluid velocity profile but with a substantial fluid rotation at the elbow exit.
Figure 3:
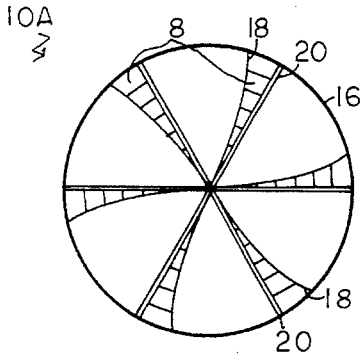
PRIOR ART FIG. 3
FIG. 3 is a prior art illustration of plan (FIG. 3A) and sectional (FIG. 3B) views of a conventional pre-rotator design.
Figure 3:
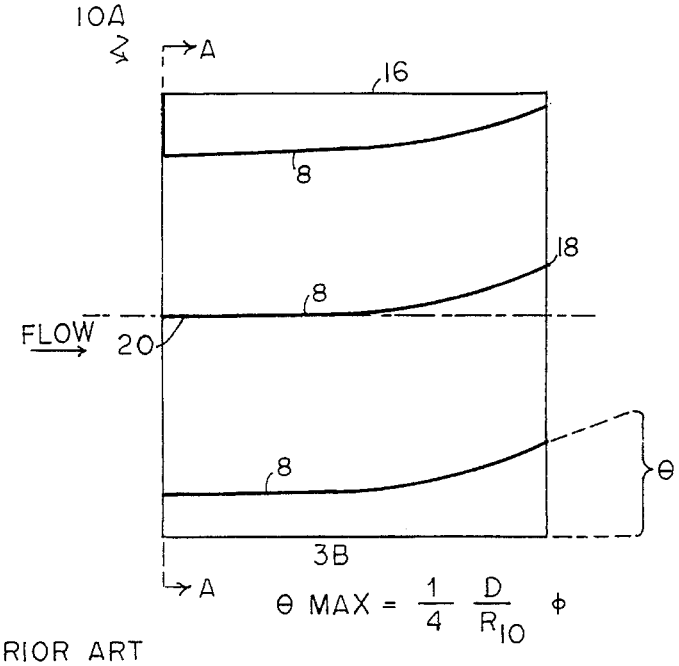
PRIOR ART FIG. 3
Figure 4:
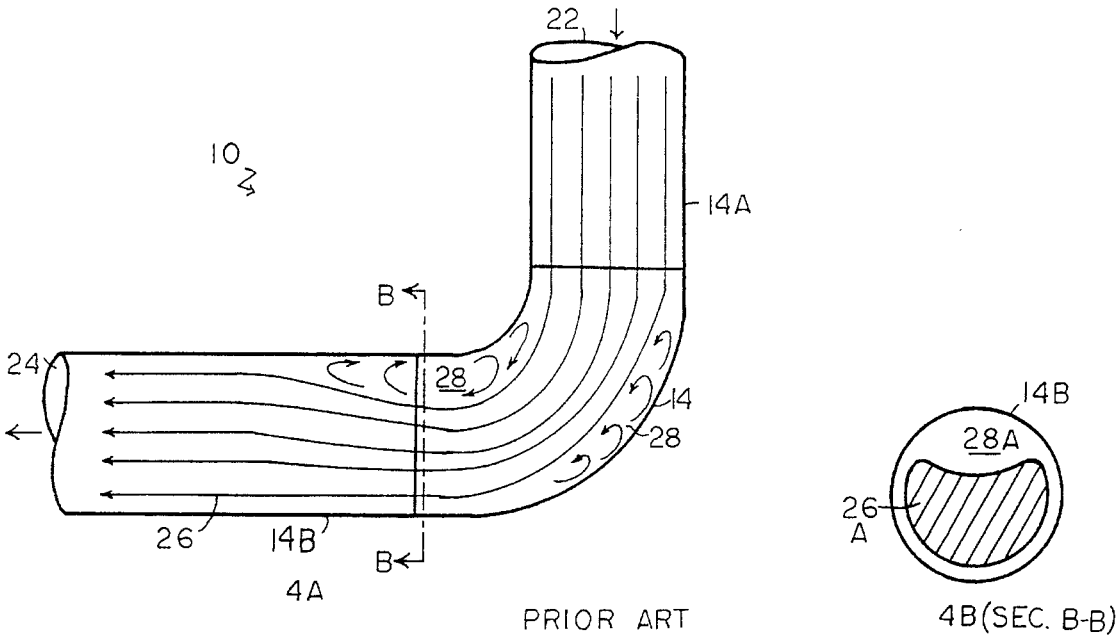
PRIOR ART FIG. 4
FIG. 4 is a prior art illustration of an actual flow streamline through a plain elbow system, FIG. 4A being a sectional view and FIG. 4B being a plan view.
Figure 5:
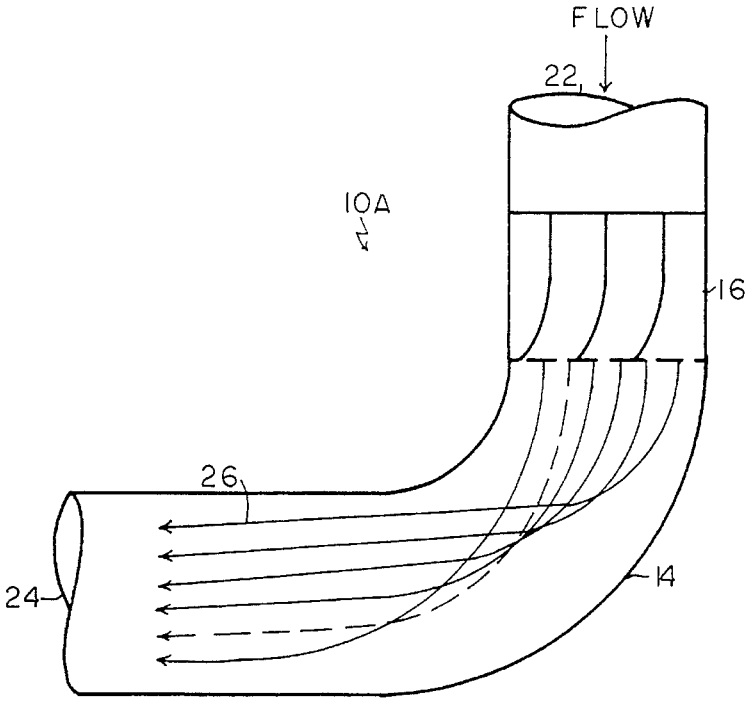
PRIOR ART FIG. 5
FIG. 5 is a prior art illustration of a laminar flow elbow system with a sectional view of an equal streamline length flow desired to achieve rotational transformation mathematically.

With reference to the drawings, there is shown in FIG. 1 a prior art plain elbow system 10 with a flow inlet 22 into a straight pipe 14A, a plain elbow 14, and a flow exit 24 out of a straight pipe 14B, with the velocity profile 12 at the pipe exit showing irregularity. FIG. 4A illustrates the actual streamline through a prior art plain elbow system 10 without the pre-rotator in side sectional and plan views showing the flow separation regions 28 created by the elbow 14 and resulting in a skewed fluid velocity profile at the elbow exit in FIG. 4B with a high fluid velocity region 26A and a low fluid velocity region 28A. FIGS. 2, 3 and 5 illustrate a prior art laminar flow elbow system, with the pipe system 10A having a prior art pre-rotator 16 inserted near the elbow inlet 14, the pre-rotator having six generally spaced-apart blades 8 having a leading edge 20 and a trailing edge 18 to direct the flow of fluid through the elbow, and showing a more uniform velocity profile 46. FIG. 2 also illustrates the continuing rotating flow path 45 of fluid upon exiting the prior art laminar flow elbow system 10A with the pre-rotator 16. FIG. 3 illustrates the prior art pre-rotator design in plan (3A) and sectional (3B) views within the pipe 16, with leading edge 20 and trailing edge 18 on the blades 8, and FIG. 5 illustrates an actual streamline 26 through the laminar flow elbow system 10A with elbow 14 and the prior art pre-rotator 16, and FIG. 2 showing the relatively flat fluid velocity profile 46 at the exit 24, but with the fluid rotating 45.

Figure 6:
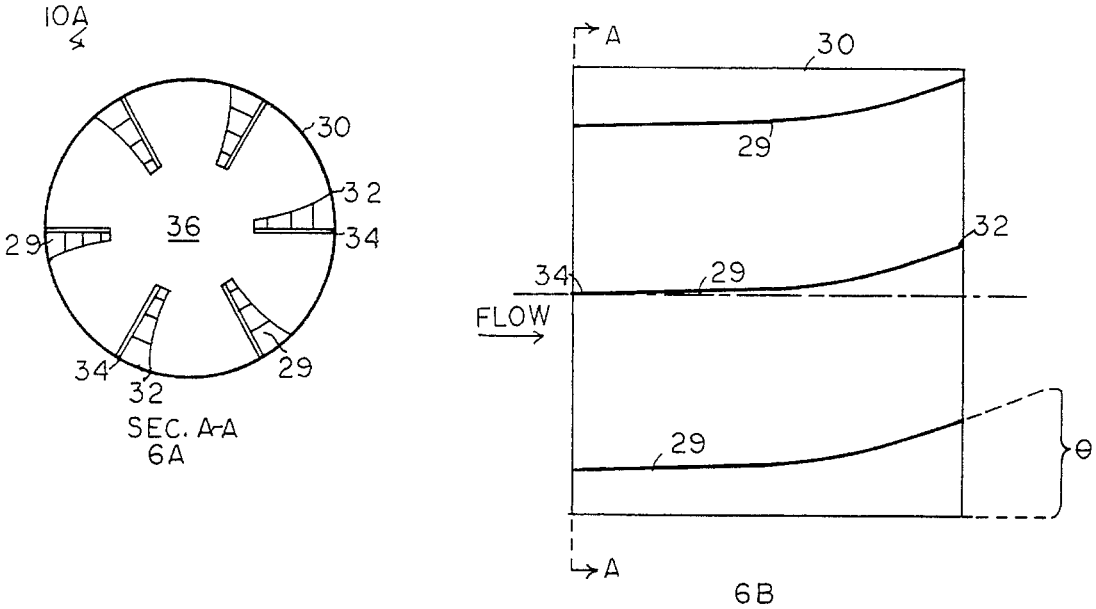
FIG. 6 illustrates the coreless forward rotation means of the invention, FIG. 6A being a plan view and FIG. 6B being a sectional view.

FIG. 6 illustrates the coreless forward rotation means 30 of the invention inserted within the laminar flow elbow system 10A, with six generally spaced-apart blades 29 each having a leading edge 34 and a trailing edge 32, with the center core being removed from the blades 29, creating an open space 36 that provides a relaxation zone for fluid flow and allowing for a flatter velocity profile to be created.

Figure 7:
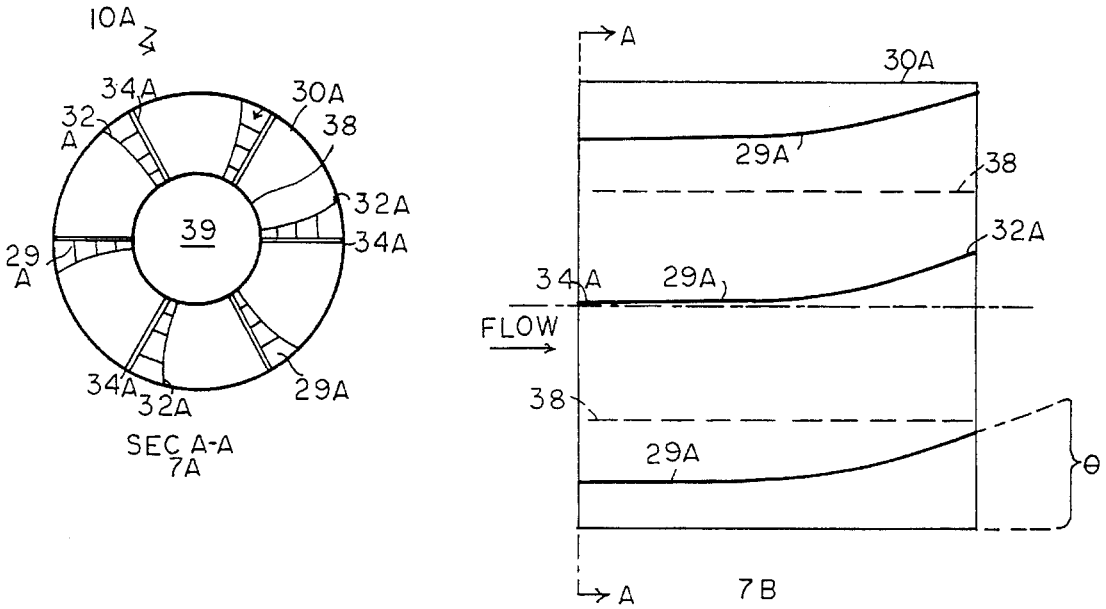
FIG. 7 illustrates the coreless forward rotation means of the invention with a central separation cylinder design, FIG. 7A being a plan view and FIG. 7B being a sectional view.
Figure 8:
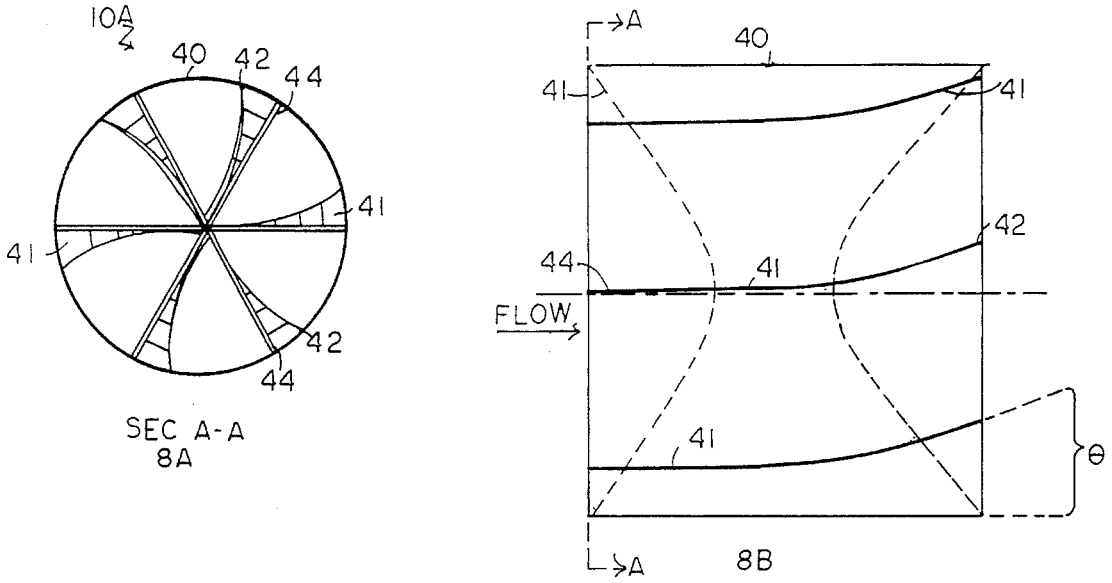
FIG. 8 illustrates a tapered blade forward rotation means, FIG. 8A being a plan view and FIG. 8B being a sectional view.

FIGS. 7 and 8 illustrate two alternate embodiments of the forward rotation means within the laminar flow elbow system 10A, with FIG. 7 showing a coreless forward rotation means 30A having six generally spaced-apart blades 29A each with a leading edge 34A and a trailing edge 32A and a central separation cylinder 38, and FIG. 8 showing a tapered blade forward rotation means 40 with the blades 41 having leading edges 44 and trailing edges 42 tapered. The alternate embodiments of the coreless forward rotation means with central separation cylinder (FIG. 7) and the tapered forward rotation means (FIG. 8), while having improved performance to the prior art pre-rotator 16 of FIG. 3, are slightly less effective than the coreless forward rotation means 30 of FIG. 6.

Figure 9:
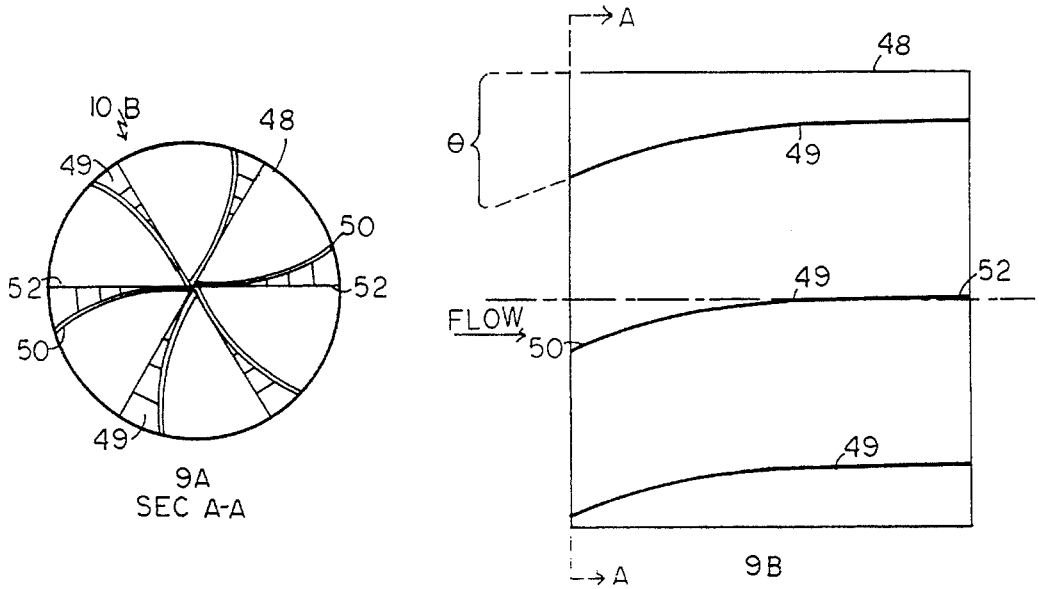
FIG. 9 illustrates a backward rotation termination means of the invention, with FIG. 9A being a plan view and FIG. 9B being a sectional view.
Figure 11:
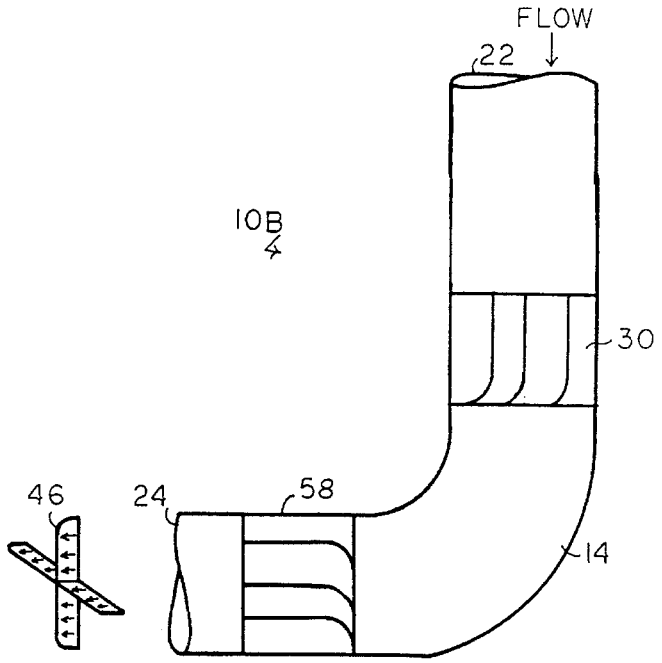
FIG. 11 illustrates a sectional view of a coreless forward rotation means of the invention, followed by an elbow, and followed by a coreless backward rotation termination means of the invention with a relatively fiat fluid velocity profile and substantially no fluid rotation at exiting.

FIG. 9 illustrates a backward rotation termination means 48 inserted within a laminar flow elbow system 10B as shown in FIG. 11, with six generally spaced-apart blades 49, each having a leading edge 50 and trailing edge 52 positioned in direct opposition to the leading edge and the trailing edge of the blades of the forward rotation means of the invention.

Figure 10:
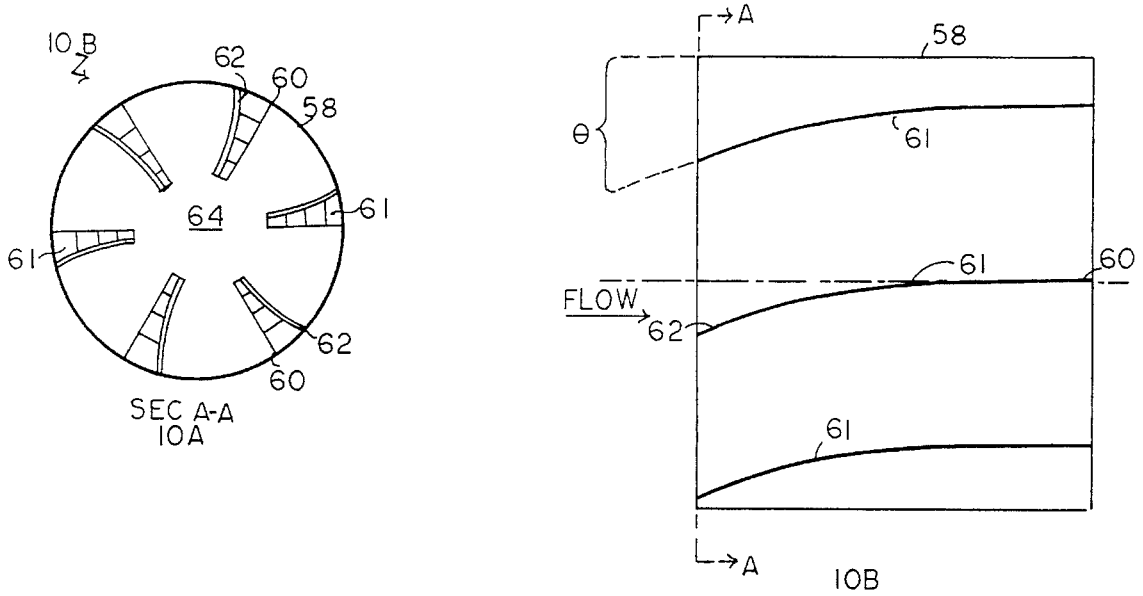
FIG. 10 illustrates a coreless backward rotation termination means of the invention, FIG. 10A being a plan view and FIG. 10B being a sectional view.

FIG. 10 illustrates the coreless backward rotation termination means 58 of the invention, with six generally spaced-apart blades 61 having a leading edge 62 and a trailing edge 60, with the center core of the blades removed providing an open space 64. The coreless backward rotation termination means is similar in construction to the coreless forward rotation means of FIG. 6, except that the blades of the coreless backward rotation termination means have a reverse configuration.

FIG. 11 illustrates the fluid rotation generated by a coreless forward rotation means of the invention 30 located upstream of an elbow 14 and the fluid rotation created by 30 being terminated by positioning a coreless backward rotation termination means of the invention 58 immediately downstream of the elbow exit 14. By utilizing the combination of a coreless forward rotation means 30, and elbow 14, and coreless backward rotation termination means of the invention 58, the fluid upon exiting the laminar flow elbow system 10B will have a relatively flat fluid velocity profile 46 and substantially no residual rotation. Alternate embodiments of the forward rotation means and backward rotation termination means can be used, such as 16 and 48, 30A and 58A, 16 and 58A, 30A and 48, or any combination, to achieve a similar, relatively fiat fluid velocity profile and essentially no residual rotation.

Figure 12:
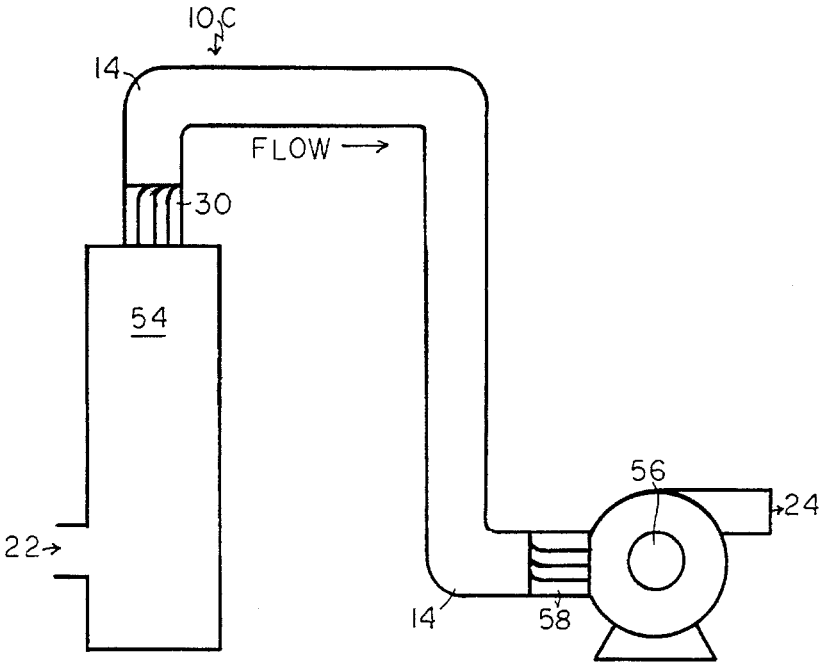
FIG. 12 illustrates a sectional view of a coreless forward rotation means of the invention, followed by an elbow, straight pipe, elbow, straight pipe, elbow and a coreless backward rotation termination means coupled to the suction of a blower.

FIG. 12 illustrates an embodiment where the coreless backward rotation termination means 58 is located substantially downstream of the coreless forward rotation means 30. In this embodiment, the angle of the blades of the backward rotation termination means 58 are adjusted to within ±10° of the fluid swirl at the inlet of said means, instead of within ±10° of the rotation angle of the fluid at the exit of the coreless forward rotation means 30, as in FIG. 6. As illustrated, the fluid enters at the inlet 22, passes through a scrubber 54, enters the laminar flow elbow system 10C through the forward rotation means 30, flows through the system and through the backward rotation termination means 58 directly into an induced draft fan 56 and out the exit 24.

Figure 13:
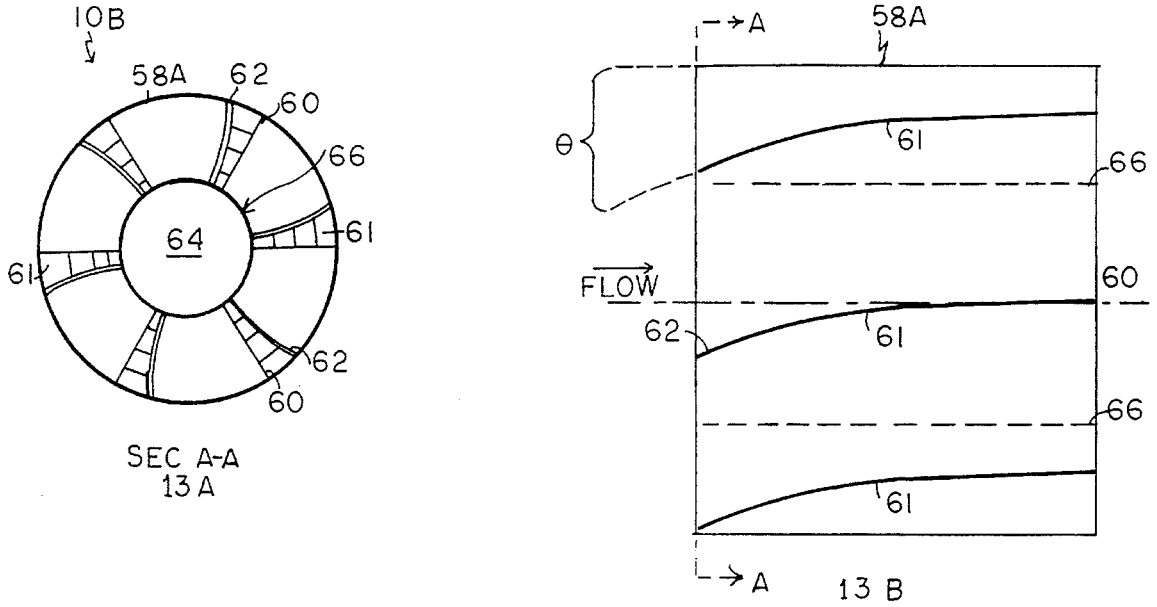
FIG. 13 illustrates a coreless backward rotation termination means with a central separation cylinder, FIG. 13A being a plan view and FIG. 13B being a sectional view.
Figure 14:
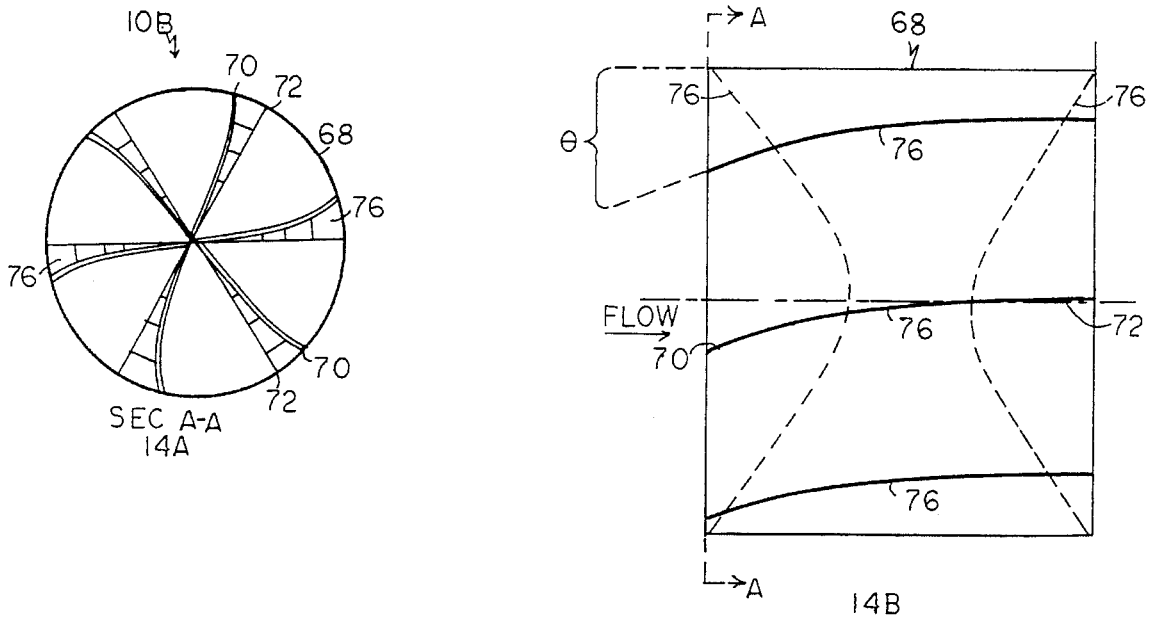
FIG. 14 illustrating a tapered blade backward rotation termination means, FIG. 14A being a sectional view and FIG. 14B being a plan view.

FIGS. 13 and 14 illustrate two alternate embodiments of the backward rotation termination means of FIG. 9 within piping system 10B, with FIG. 13 showing a coreless backward rotation termination means 58A with a leading edge 62 and a trailing edge 60 and a central separation cylinder 66, and FIG. 14 showing a tapered blade backward rotation termination means 68 with leading edges 70 and trailing edges 72 being tapered.

Figure 15:
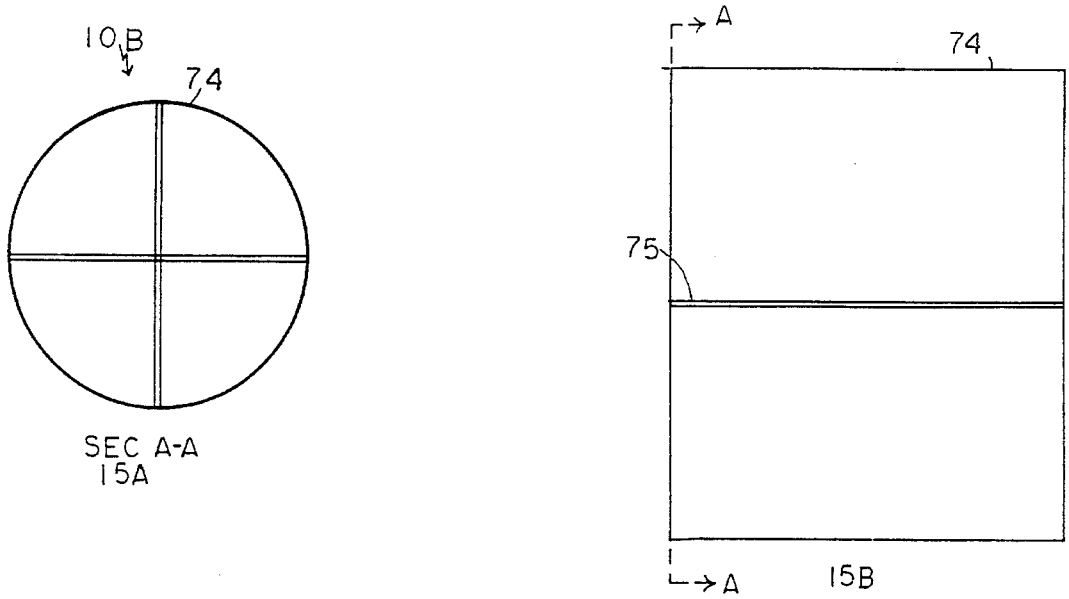
FIG. 15 illustrates another embodiment of a rotation termination means.

FIG. 15 illustrates another embodiment of a rotation termination means 74 in a cross configuration 75 within a laminar flow elbow system 10B. This configuration was tested as well as other similar designs with more blades and where the blades do not touch, and they were shown to be ineffective in preventing fluid rotation upon the fluid's exit from the pipe.

The standard prior an pre-rotator design is shown in FIG. 3 and in laboratory testing it has been found that as the angle Theta (FIG. 3A) of the pre-rotator is increased from zero degrees (no curvature; i.e., axial to pipe flow) to the Theta max angle (FIG. 3B), the pressure drop of the pre-rotator increases, the velocity profile becomes flatter and the residual rotation of the fluid downstream of the elbow is approximately equal to the pre-rotator angle Theta. As the pre-rotator angle Theta is increased past the Theta max angle, the pressure drop continues to increase, and the residual rotation of the fluid after the elbow continues to equal approximately the pre-rotator angle Theta.

A Performance Data Table is shown below for a standard prior art pre-rotator with a short radius elbow close coupled downstream of the pre-rotator (FIG. 2) and tested with ambient air at a velocity of approximately 100 ft./sec. The calculated Theta max angle for the pre-rotator attached to a short radius elbow (R/D=1) is 22½° (FIG. 3B).

PRIOR ART PRE-ROTATOR PERFORMANCE DATA

| Prerotator Angle Theta | Pressure Drop Increase of Prerotator & Elbow as Compared to Plain Elbow | Variation Coefficient of Velocity* | Rotation Angle at Elbow Outlet |
|---|---|---|---|
| 10-degrees | 16% | 0.284 | approx. 10° |
| 18-degrees | 15% | Not Available | approx. 18° |
| 22-degrees | 15% | 0.103 | approx. 22° |
| 22-½-deg. | Calc. Theta Max Angle | | |
| 26-degrees | 22% | Not Available | approx. 26° |
| 33-degrees | 25% | Not Available | approx. 33° |

*Variation Coefficient of velocity, C, is a classic statistical technique to analyze and compare the flatness of a velocity profile. The smaller the value, the more uniform the velocity profile where a value of zero indicates a flat velocity profile.

$$C = \left[ \sum_{i=1}^{n} \left( 1 - \frac{V_i}{V_a} \right)^{0.5} \right]$$

$V_i$ = normal velocity measured at traverse point i, ft/sec
$V_a$ = averaged normal velocity for all traverse points, ft/sec Although the velocity profile 46 (FIG. 2) of a prior art pre-rotator mounted upstream of an elbow is much improved compared to an elbow alone 12 (FIG. 1), it is desired to create a flatter velocity profile at a lower pressure drop.

The coreless pre-rotator of the invention 30 (FIG. 6) creates a flatter velocity profile at lower pressure drop compared to the standard prior art pre-rotator (FIG. 3). The coreless forward rotation vane is identical to a standard prior art pre-rotator, except the center core is removed. Performance data is shown below for a coreless forward rotation vane with a close-coupled, downstream, standard, short radius elbow processing air at a velocity of approximately 100 ft/sec.

CORELESS CENTER FORWARD ROTATION VANE (CFRV) PERFORMANCE DATA

| CFRV Angle Theta | Pressure Drop Increase of CFRV & Elbow as Compared to Plain Elbow | Variation Coefficient of Velocity | Rotation Angle at Elbow Outlet |
|---|---|---|---|
| 33-degrees | 10% | 0.082 | approx. 33° |

The advantages of the coreless forward rotation vane as compared to the standard prior art pre-rotator are: When comparing the 33-degree coreless forward rotation vane to the standard 33° prior art pre-rotator, the pressure drop of the coreless forward rotation vane is 60% lower ((25%–10%)/25%); when comparing the 33° coreless forward rotation vane to the standard 22° prior art pre-rotator which is close to the Theta max angle of 22½°, the pressure drop of the coreless forward rotation vane is 33% lower ((15%–10%)/15%) and the Variation Coefficient of Velocity is 20% lower ((0.103–0.082)/0.103), indicating a flatter velocity profile; because the center core is missing in the coreless forward rotation vane, the manufacturing cost is lowered, because less material is used and only half the welding is required during manufacturing; and because the center core is missing in the coreless forward rotation vane, there are no pinch points in the coreless forward rotation vane that could plug the device when processing fluids containing particulate materials, fibers, or other material prone to plugging the rotator.

Another forward rotation vane device that has the characteristics of providing a relaxation zone for fluid flow while travelling within the forward rotation vane as well as eliminating the center body constriction to flow, is a coreless forward vane with a central separation cylinder design (FIG. 7), which showed improved performance compared to a standard prior art pre-rotator (FIG. 3). A further forward rotation vane design is the tapered blade forward rotation vane design (FIG. 8).

It is recognized that there are many instances in fluid processing operations where a fluid is rotating, but does not have a substantially flat velocity profile, and in those cases, the backward rotation termination means, with blade angles designed to match the rotating fluid angle Theta at the entrance of said means, when installed after a curved pipe section or in a straight pipe section, will substantially terminate fluid rotation without greatly affecting the quality of flatness of the received fluid velocity.

For example, it has been found that when a forward rotation means is installed in front of an elbow, and when the vane angle of said means is below the angle Theta, the fluid velocity profile exiting the elbow is improved when compared to a plain elbow, but is not substantially flat because an adequate amount of rotational transformation was not imparted on the fluid to negotiate the elbow turn and eliminate the effects of the elbow. It has also been found that when operating above the angle Theta, the fluid velocity profile exiting the elbow becomes essentially flat.

When a backward or opposite rotation termination means is installed in the instance where there is fluid rotation but the fluid velocity profile is not flat, the fluid rotation will essentially terminate after passing through said means and the velocity profile will remain essentially as it entered said means. A backward rotation termination means could also be utilized in a straight pipe to receive a rotating fluid with a non-flat velocity profile created by an upstream propeller pump, out-of-plane-elbows-in-series, cyclone, valve, or other device, and terminate fluid rotation without affecting the non-flatness of the entering fluid velocity profile.

Thus, the new and improved laminar flow pipe elbow, system and method of the invention, being comprised of a combination of a forward rotation vane and a backward rotation vane within the pipe system placed at arranged points before and after the elbow, provides for a fluid flow with a relatively or essentially the same velocity profile upon exiting the pipe and without any substantial increase in pressure drop of the fluid. Further, the coreless forward and coreless backward rotation vanes of the invention and other embodiments as described and illustrated, provide for savings in operating, functioning and manufacturing costs and efficiency over the prior art pre-rotator.

We claim:

1. A pipe section apparatus which comprises:

a) a substantially straight post-pipe section to define the flow path of a fluid, said pipe section adapted for inclusion directly after a curved pipe section having an inlet and an exit; and b) a fluid rotation termination-imparting means fixed within the said straight pipe section, said rotation termination-imparting means to receive a rotating fluid exiting from the curved pipe section to terminate substantially the fluid rotation of the exiting fluid by rotating the fluid in the opposite direction without substantial deterioration of the received fluid velocity profile.

2. The apparatus of claim 1 which includes a curved pipe section at the inlet of the post-pipe section.

3. The apparatus of claim 2 wherein the curved pipe section comprises a curved pipe section having a curvature of from about 30° to a return bend of 180°.

4. The apparatus of claim 1 which includes a curved vane means for imparting forward rotation to the fluid at the inlet of the curved pipe section to provide a substantially flat velocity profile for the fluid at the exit of the curved pipe section.

5. The apparatus of claim 2 which includes a straight pre-pipe section to define a flow path for a fluid, just prior to the inlet of the curved pipe section, and which includes fluid forward-rotation-imparting means fixed within said straight pre-pipe section.

6. The apparatus of claim 5 wherein the forward-rotation-imparting means comprises a plurality of vanes having a curvature and being generally uniformly positioned about the center axis of the straight pre-pipe section.

7. The apparatus of claim 1 wherein the rotation-termination-imparting means comprises a plurality of generally uniformly spaced-apart vanes having a curvature about a center axis of the straight post-pipe section, the vanes having a leading edge and a trailing edge, the trailing edge having a substantially zero angle of departure with respect to the centerline of the pipe at the exit of the straight post-pipe section.

8. The apparatus of claim 7 wherein the rotation-termination-imparting means is characterized by a coreless open center section, with the plurality of vanes extending from an interior surface of the straight post-pipe section inwardly a short distance toward the center axis of the straight post-pipe section.

9. The apparatus of claim 5 wherein the forward rotation-imparting means to impart forward-rotation motion to the fluid comprises a plurality of vanes having a curvature with a leading and trailing edge, and wherein the vanes extend a short distance from the interior surface of the straight pre-pipe section toward the center axis of the straight pre-pipe section and characterized by a coreless open center section.

10. The apparatus of claim 9 wherein the vanes extend inwardly a distance of up to about 10% to 70% of the radius of the straight pre-pipe section.

11. The apparatus of claim 9 wherein the forward rotation imparting means includes an open ended cylinder at the coreless center section and extending along the axis of the said section.

12. The apparatus of claim 4 wherein one or more of the vanes are curved and characterized by a tapered trailing or leading edge, or both.

13. The apparatus of claim 1 which includes downstream of the exit of the straight post-pipe section a fluid receiving means which is designed for the fluid entering said means to have substantially no fluid rotation and a substantially flat fluid velocity profile.

14. The apparatus of claim 1 wherein the fluid rotation-termination-imparting means is positioned at or within about one diameter from the exit of the curved pipe section.

15. The apparatus of claim 13 wherein the fluid receiving means is selected from the group consisting of equipment having rotating impellers in the fluid flow path.

16. The apparatus of claim 13 wherein the fluid receiving means is selected from the group consisting of equipment for the measuring or sampling of fluid in the fluid flow path.

17. The apparatus of claim 1 wherein the fluid rotation-termination-imparting means has an inlet angle of attack theta within ±10° of the rotation angle theta of the fluid velocity vector entering said means.

18. The apparatus of claim 5 wherein the fluid rotation termination-imparting means comprises a plurality of vanes characterized by a coreless open center section.

19. A pipe section apparatus which comprises:

a) a substantially straight pre-pipe section having an inlet and an outlet to define a fluid flow path and an interior wall and adapted for inclusion prior to curved pipe sections having an inlet and an exit;

b) a forward fluid rotation-imparting means fixed within the straight pre-pipe section to impart sufficient rotation to the fluid to minimize turbulence of the fluid and to provide for a substantially flat velocity profile for the fluid at the exit of a curved pipe section, the forward rotation-imparting means having a plurality of uniform, generally uniformly spaced-apart, radially inwardly extending vanes having a curvature and a trailing and leading edge, the vanes extending radially inwardly from the interior wall of the straight pre-pipe section a radial distance of from about 10 to 70% of the radius of the said straight pre-pipe section and extending toward the center axis of the straight pre-pipe section, and characterized by an open, circular, coreless center section when viewed along the axis of the straight pre-pipe section.

20. The apparatus of claim 19 wherein one or more of the edges of the vanes are tapered.

21. The apparatus of claim 19 which includes an open-ended cylinder within the center axis having an exterior surface and generally longitudinally aligned with the center axis to form the open, coreless center section, the ends of the vanes extending to the exterior surface of the said cylinder.

22. The apparatus of claim 19 which includes a curved pipe section at the outlet of the straight pre-pipe section.

23. The apparatus of claim 22 which includes a fluid rotation termination-imparting means at the exit of the curved pipe section to receive a rotating fluid exiting from the curved pipe section and to terminate substantially the fluid rotation of the exiting fluid by rotating the fluid in an opposite direction without substantially changing the fluid velocity profile.

24. The apparatus of claim 19 wherein the fluid rotation termination-imparting means is fixed within a straight post-pipe, the fluid rotation termination-imparting means having a plurality of uniform, generally uniformly spaced-apart, radially extending vanes having a curvature and a trailing and leading edge, and characterized by an open, generally circular, coreless center section when viewed along the axis of the straight post-pipe section, and wherein the leading edge of the vanes presents an angle of attack about theta ±10° to the rotating fluid from the exit of the curved pipe section.

25. The apparatus of claim 24 which includes downstream of the exit of the fluid rotation termination-imparting means a fluid receiving means having rotating impeller means in the fluid flow path.

26. The apparatus of claim 22 which includes an open-ended cylinder within the center axis having an exterior surface and generally longitudinally aligned with the center axis to form the said open, coreless center section, the radial ends of the vanes extending to the exterior surface of the said cylinder.

27. A post-pipe section apparatus which comprises:

a) a substantially straight post-pipe section having an inlet and an outlet to define a fluid flow path and adapted for inclusion after an exit of a curved pipe section having an inlet and an exit; and b) a fluid rotation termination-imparting means within the straight post-pipe section to impart sufficient rotation to the fluid from the exit of the curved pipe section to substantially terminate any further rotation of the exiting fluid without substantially changing the fluid velocity profile, the fluid rotation termination-imparting means having a plurality of radially extending vanes having a curvature and a trailing and leading edge, the vanes extending inwardly from the exterior wall of the straight post-pipe section a radial distance of from about 10 to 70% of the radius of the said straight post-pipe section and extending toward the center axis of the straight post-pipe section, and characterized by an open, generally circular coreless center section when viewed along the axis of the straight post-pipe section, and the leading edge of the vanes presenting an angle of attack theta ±10° to the fluid from the exit of the curved pipe section and a substantially zero angle of departure.

28. A method of providing a fluid in a fluid flow-path having substantially no fluid rotation at the exit of a curved pipe section, and a substantially flat fluid velocity flow profile, which method comprises:

a) providing fluid rotation to a fluid in a flow-path prior to passing the fluid into a curved pipe section to provide a fluid at an exit of the curved pipe section with a substantially flat fluid velocity profile;

b) passing the forward-rotating fluid at the exit from the curved pipe section through a rotation-termination-imparting means with a zero angle of departure to terminate substantially the fluid rotation of the fluid, while maintaining a substantially flat fluid-flow velocity profile.

29. The method of claim 28 which includes positioning the rotation-termination-imparting means directly within about one diameter of the exit of the curved pipe section.

30. The method of claim 28 wherein the rotation-termination-imparting means comprises a plurality of generally uniformly spaced-apart curved vanes having leading and trailing edges within a straight post-pipe section and which includes positioning the vanes with a about a theta ±10° angle of attack on the leading edges in the direction of fluid flow and about a zero angle of attack on the trailing edges.

31. The method of claim 28 wherein a forward rotation-imparting means to impart forward rotating of the fluid or the rotation termination imparting means comprises a plurality of curved, spaced-apart vanes in a straight post pipe section and wherein one or both of the rotation means are characterized by an open, coreless, center section.

32. The method of claim 31 which includes employing a particulate-containing fluid stream.

33. The method of claim 31 which includes providing a generally circular open coreless section to one or both rotation means.

34. The method of claim 28 which includes directing the fluid from an exit of the rotation-termination-imparting means into equipment having rotating impellers in the fluid flow path.

35. The method of claim 28 which includes imparting a selected forward fluid rotation to a fluid in a flow path prior to the fluid passing into an entrance of the curved pipe section by providing a plurality of vanes having a leading edge at the entrance of the curved pipe section with the leading edge of the vanes having about a zero angle of attack to the direction of fluid flow.

36. The method of claim 28 which includes positioning the rotation termination-imparting means substantially downstream of the exit of the curved pipe section with one or more curved pipe sections intermediate and upstream of the rotation-terminating-imparting means.

37. A method of minimizing turbulence of a fluid passing through a curved pipe section and providing a flat velocity profile of the fluid at the exit of the curved pipe section which method comprises:

a) imparting a forward rotation to the fluid at the entrance to the curved pipe section, the rotation imparted by a plurality of generally uniformly spaced apart, radially disposed vanes about the axis of a straight pre-pipe section disposed before the curved pipe section, the vanes having a leading and trailing edge, and presenting the leading edge at a substantially zero angle of attack to the fluid and presenting a trailing edge at theta ±10° departure angle, and disposing the vanes radially inwardly from about 10 to 70% of the radius of the straight pre-pipe section and providing a generally circular coreless open center section when viewed across the axis of the pre-pipe section as a fluid relaxation section.

38. The method of claim 37 which includes providing an open ended cylinder as the coreless open center section and extending the vanes to the exterior surface of the cylinder.

* * * * *